US006240591B1

(12) United States Patent
Maxted

(10) Patent No.: US 6,240,591 B1
(45) Date of Patent: Jun. 5, 2001

(54) BULL-NOSED CLEANING, AND COVING, DRYWALL TOOL

(76) Inventor: Kevin Maxted, 515 S. Sunshine Ave., El Cajon, CA (US) 92020

( * ) Notice: Subject to any disclaimer, the term of this patent is extended or adjusted under 35 U.S.C. 154(b) by 0 days.

(21) Appl. No.: 09/227,931

(22) Filed: Jan. 8, 1999

(51) Int. Cl.[7] ..... B05C 17/10; B05D 1/40

(52) U.S. Cl. ..... 15/235.7; 15/236.07; 15/235.4; 15/245.1; 425/458

(58) Field of Search ..... 15/235.4, 235.5, 15/235.6, 235.7, 236.01, 236.07, 236.09, 245.1; D8/45; 425/87, 458

(56) References Cited

U.S. PATENT DOCUMENTS

| | | | | |
|---|---|---|---|---|
| 407,562 | * | 7/1889 | Agan | 15/236.07 |
| 1,746,877 | * | 2/1930 | Tompkins | 15/236.01 |
| 2,247,604 | * | 7/1941 | Christman | 425/458 |
| 3,280,662 | * | 10/1966 | Frankenfield | 15/235.4 |
| 4,766,634 | * | 8/1988 | De Vitis | 15/235.7 |
| 4,784,598 | * | 11/1988 | Kranz | 15/235.4 |
| 5,240,394 | * | 8/1993 | James | 15/235.7 |

FOREIGN PATENT DOCUMENTS

| | | | | |
|---|---|---|---|---|
| 1554715 | * | 10/1979 | (GB) | 15/235.4 |

* cited by examiner

*Primary Examiner*—Randall E. Chin
(74) *Attorney, Agent, or Firm*—Fuess & Davidenas

(57) ABSTRACT

A handheld, durable, easy-maintenance, easy-hold, precision-contour drywall finishing tool substantially in the shape of a round disk presents both convex and concave, or bull-nose, peripheral regions repectively suitable for coving, and for cleaning, flowable building material within, respectively, concave wall joints >90° and <180° nominally 135°, and convex wall joints >180° and <270° nominally 225°. The disk is preferably about 12 cm. in diameter, with its otherwise circular peripheral edge relieved over about 45° of arc in the shape of a concave curve, or bull nose, of some 3.5 cm diameter. Preferably one major surface of the disk is flat while the opposing surface slopes radially symmetrically from a central region of greater thickness, about 0.75 cm., towards a lesser thickness, about 3 mm., at the edge of the disk. A feature, preferably a knob of about 0.75 cm height by 3 cm. diameter integrally molded at the center of the disk's sloping surface, abets grasping and holding the tool with the hand and fingers so as to force and to draw the tool, which flexes and bends slightly backward, against flowable building material during dry wall construction so as to, dependent upon rotational orientation of the tool, contour the flowable building material into either the concave or convex wall joints.

16 Claims, 1 Drawing Sheet

FIG. 1
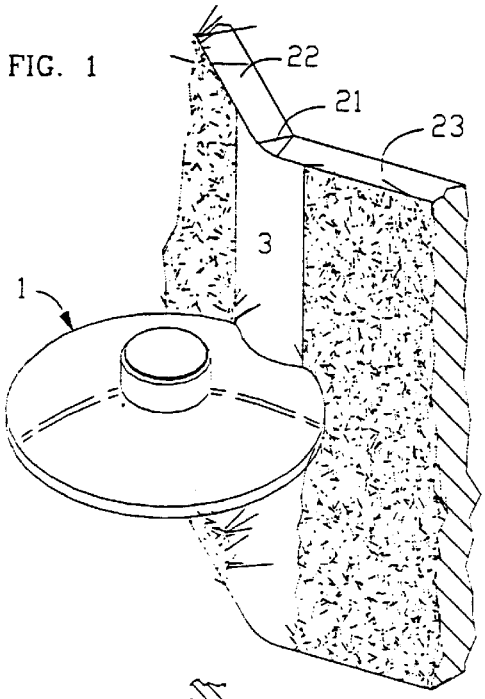
FIG. 2
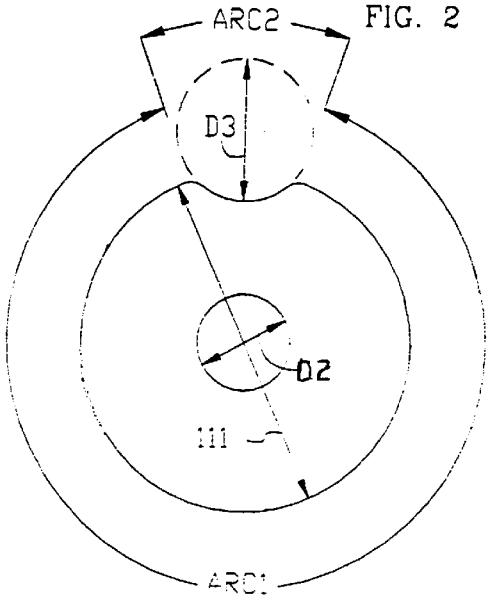
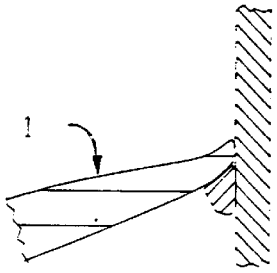
FIG. 5
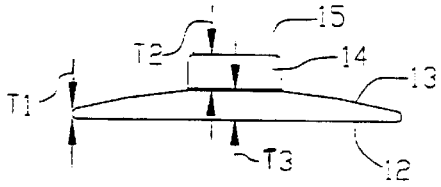
FIG. 3
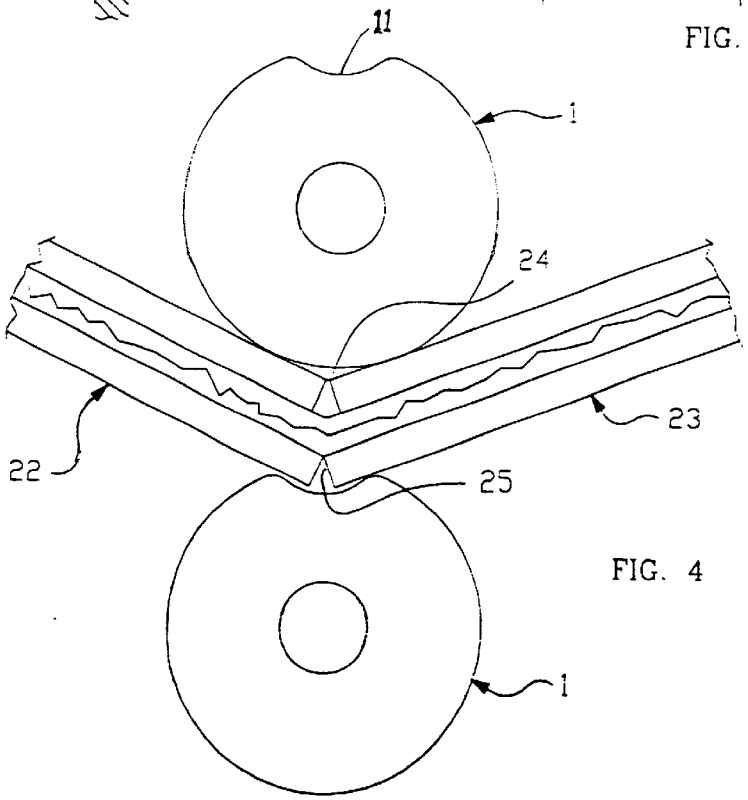
FIG. 4

BULL-NOSED CLEANING, AND COVING, DRYWALL TOOL

BACKGROUND OF THE INVENTION

1. Field of the Invention

The present invention generally concerns drywall finishing tools.

The present invention particularly concerns a drywall finishing tool directed to the manipulation of drywall compound in selected wall joints that are formed from and by drywall panels abutting at a particular range of angles.

2. Description of the Prior Art 2.1 General Drywall Finishing

The tool of the present invention can be sufficiently understood without having much understanding of, nor appreciation for, the drywall finishing process. However, a good hand tool is not merely operative in a process, but facilitates, or even dictates—hopefully in a new and improved manner—the performance of the process. Accordingly, some understanding of the drywall finishing process is not adverse to appreciation of the tool of the present invention.

The finishing of drywall is sometimes called taping, or even spackling. As well as shaping tools like that of the present invention, a compound pan and 5", 8", and 10" drywall knives are generally used. Some drywall finishers prefer a 6-in. tool for applying the first coat of compound, followed with a 10-in. tool for the second coat and a 12-in. blade for the final skim coat. Generally speaking, wider knives are harder to control. All tool blades are desirably flexible, and the tool of the present invention will also be seen to be flexible.

Selection of compound is important. Compound is available in two types. One is called a setting compound that hardens by a chemical reaction. The other is a drying compound that cures by evaporation. The latter is available in powder or a ready-mix version, but for most people the ready-mix version is much more convenient. A typical compound suitable for use with existing tools and with the tool of the present invention is the relatively new ready-mix drying compound called Lightweight Plus 3 available from United States Gypsum (USG). It reportedly shrinks less, weighs less and is easier to sand than the company's standard drying compound, without sacrificing any strength.

Joint tape may be either paper tape or a self-sticking fiberglass mesh tape. The great advantage of the fiberglass tape is that it eliminates the need for the first coat of compound—and that's a major saving in labor. But tape manufacturers say the fiberglass product should be used only with setting compounds, not drying ones. In the opinion of many professionals the difficulties of working with a setting compound outweigh the advantage of using the fiberglass tape.

There are various approaches to the finishing process. However, a few rules of thumb are always approprialean as possible.

This means wiping off the excess compound on the edge of the pan after each pass with the tool. Second, dried compound is never mixed into fresh compound. Even the smallest piece of dried debris will leave a messy gouge in the finished surface. If dried compound finds its way into a pan or pail, it must be removed immediately. Finally, the surface of the compound will be only as smooth as the stroke you use to apply it. (The tool of the present invention will be seen to excel in supporting smooth and even stroking of drywall compound.) In the beginning, an inexperienced finisher should make a concerted effort to lengthen his/her strokes and keep the tool aligned with the direction of the joint. Until a finisher accrues experience and gets the knack, compound may squeeze off the tool and fall to the floor. But by loading the tool with less compound, the finisher can usually minimize the mess.

Joint sequence usually begins with the butt joints—those on the ends of the boards—followed by tapered joints—those along the edges—followed by inside corners and then outside corners. (The tool of the present invention will be seen to be applicable to both inside and outside corners.) With normal straight-edge tools inside corners normally have to be done in two steps because it is only possible to work on one side of the joint at a time. If any attempt is made to finish both sides at once, a conventional straight-edge tool will foul the first side while work is attempted on the second side. (The tool of the present invention, like some few others in the prior art, will be seen to advantageously permit finishing both sides of an inside corner at one time.)

2.2 Finishing of Butt and Tapered Joints

Although the finishing of butt and tapered joints will be seen to be substantially irrelevant to the preferred use of the tool of the present invention, the conventional manner of finishing these joints will be discussed in a few paragraphs within this BACKGROUND OF THE INVENTION section for ease of later comparison to the preferred techniques, and steps, for using the tool of the present invention. Drywall finishing work begins by mixing of joint compound, sometimes called mud. Although mixing isn't absolutely necessary with ready-mix compounds, to do so smooths out the compound and makes it easier to apply. Starting at a butt joint, the finisher loads up a 5-in. tool, making sure that its corners are clean, and applies the compound starting at one end of the joint. Application proceeds as smoothly as possible, the tool being reloaded when depleted of compound. The cleaning of the tool on the side of the pan and the smoothing of the entire joint preferably transpires in one stroke.

The tool is not pressed so hard that all of the compound is removed. If the surface is scraped clean in an area, compound must be re-applied because the paper tape won't stick to the paper covering on the drywall without compound underneath. Once the compound is smooth, a piece of joint tape is cut to length and embed in the compound by use of the fingers. The middle of the paper is aligned directly over the middle of the butt joint.

The tape is smoothed into the compound with a 5-in. tool, any excess that squeezes out being wiped off. The goal is to get enough compound on the wall to hold the tape, but not so much as to leave a noticeable bump. After practice a finisher is able to get a relatively smooth surface with the tape straight and flat.

Once the tape is in place, the entire joint is covered with more compound, this time using an 8-in. tool. The same techniques are employed as described for the 5-in. tool.

One of the most difficult joints is a ceiling butt joint. In the first place, the finisher is working over his or her head, which is always awkward. And in the second, a butt joint has no tapered edges that tend to hold compound better. To start such a joint, the tool is loaded as before and pressed against the ceiling. The tool is then slowly moved across the joint in a smooth stroke while being progressively flattened during the course of movement. This motion helps reduce falling compound while at the same time yielding a smoother surface. This movement is difficult for beginners, but, with practice, mess can be held to a minimum.

Tapered joints are easier to finish because of the depression built into the long edges of all drywall panels. They are nonetheless approached just like the butt joints. First, the joint is filled the joint with compound using a 5-in. tool. Then, the tape is embedded by use of the fingers, and smoothed into place with the 5-in. tool. Finally, the first coat is finished by applying compound with an 8-in. tool. When doing flatwork, as the butt and tapered joints are sometimes called, it makes sense to cover all screw and/or nailheads, too. Joint compound is simply over each of them, with any excess scraped off.

2.3 Corner Joints

Corner joints, both inside and outside, will be seen to be most similar to certain other particular joints that are the province of the tool of the present invention. As mentioned ear except the first—of the finishing process has to be done in two steps, to allow drying time in between. Although this seems inconvenient, sensible planning permits organizing work in a way that incorporates the needed drying time.

To start an inside joint, a 5-in. tool is first loaded on one corner only. The compound is then applied to one wall only with a smooth, steady stroke. Working in this fashion limits the amount of compound that squeezes out. The other corner of the tool is then loaded and used to coat the other side of the joint. Fouling of the first side while coating the second is inevitable, but should be avoided as much as possible.

A piece of tape is next cut to length and folded down the middle. The tape is carefully pushed into the joint by use of the fingers. The fold in the paper must lines up with the corner of the joint. The tape is embedded on one side of the joint at a time using a 5-in. tool. The finisher does not bear down hard, but keeps steady and even pressure on the tool, doing his or her best to keep the surface smooth. Once the excess compound has been removed from both sides, a top coat is applied to one side of the joint using an 8-in. tool.

The inside corners along the ceiling are finished in the same way. When those are complete, move on to any outside corners. The first step in finishing these is to attach metal corner bead to the joint with drywall screws or nails. Then, using an 8-in. tool, the area over the corner bead is filled with compound. Work proceeds on one side first and then on the other.

Coat both sides of all inside corners completes the first coat of compound. Once everything is dry, any ridges or chunks of dried compound are scraped off by use of the 5-in. tool. If the job of applying the compound was done reasonably, sanding isn't necessary.

Any depression is easy to fill on the next coat, but a ridge will prevent the tool from laying flat and will ruin any hopes of a smooth second tool is used to apply a second coat of compound, following the same joint sequence as was followed for the first coat. The whole process is repeated for a third coat. When this coat is dry, the surface is sanded with 180- or 220-grit paper.

When the mess is vacuumed up, and a coat of primer applied to the walls, the walls will then be ready for paint or wallpaper.

2.4 Automated Taping Tools

Successful completion of any drywall job—large or small—takes skill, time and effort. Certain tools available from Ames Taping Tool Systems Company, Inc. are eminently compatible, and usable, with the tool of the present invention. Ames tools are standard in the U.S. drywall installation and finishing industry, Ames having provided drywall contractors, tapers and finishers with automated equipment since 1939. Ames equipments currently produce the highest quality, most cost effective method of taping and finishing drywall.

In particular, the Ames Bazooka™ brand automatic taper simultaneously applies tape and joint compound to all wallboard joints—horizontal and vertical joints, ceiling joints, interior/exterior corners and angles. (Bazooka™ is a registered trademark of Ames Taping Tool Systems Company, Inc.) The Bazooka taper automatically dispenses the precise amount of tape and compound for fast, efficient operation. It is used in conjunction with other tools such a corner roller, a flat finisher,. a corner applicator, a corner finisher, a nail spotter, a loading pump, a gooseneck adapter, and finisher handles.

The Ames Bazooka™ brand automatic taper may suitably be used for initial application of tape and joint compound to the selfsame particular drywall joints that will later be seen to suitably be finished by the drywall finishing tool of the present invention.

2.5 Particular Previous Drywall Finishing Tools

U.S. Pat. No. 4,097,951 to Hurtt for a SPREADER HAVING INTEGRALLY MOLDED DEFORMABLE HANDLE AND BENDABLE BLADE concerns a toll alleged to be especially effective for use with fast hardening metal fillers comprising resin and a catalyst. The spreader, which may be integrally molded in a continuous combination of injection and blow molding, comprises (i) an elongated handle which is hollow and deformable and (ii) a blade which is solid, whereby sculpturing and contouring may be achieved more readily through hand manipulation and the spreader may be more easily cleaned.

The precturable by molding, and deformable in use.

U.S. Pat. No. 4,654,919 for a SPREADER TOOL FOR APPLYING PLASTER AND CEMENT TO WALLBOARD, AND THE LIKE to Liberman concerns a tool for spreading plaster, or the like, on wallboard surfaces. In a first embodiment the tool includes a contoured surface having two end tip portions and a mid-portion contained in a plane spaced from the end tip portions. The tool includes a backing layer which gives structural integrity to the tool, and a flexible application-surface layer which projects beyond the outer edge of the backing layer. In use, the plaster is applied to the wallboard surface, and the projecting outer edge of the flexible layer is forced against the wall and pulled along to obtain a flat surface to spread the plaster out along the wallboard surface in an even and smooth manner to cover up cracks and tape. In a second embodiment, approximately half of the tool has a contoured surface, with the other half being planar. In this embodiment, the tool is used to distribute the plaster along the general wallboard surface area. This is accomplished by applying pressure to the planar portion to cause the plaster to extend outwardly between the curved portion of the tool and the adjacent wallboard surface. The tool is then used to smooth out that portion of the plaster positioned between the curved portion and the wallboard portion.

The present invention will be found to involve a tool that also has and presents contours. However, the contours of the tool of the present invention will later be observed, in accordance with the tool's function performed on a workpiece wall of different contour than is addressed by the Liberman tool, to be different than the Liberman tool.

U.S. Pat. No. 4,784,598 to Kranz, et. al. for a DRYWALL TOOL concerns a tool for applying drywall compound to a drywall joint is disclosed. The tool includes an application member of resilient flexible material. The member has a generally flat application surface and an arcuate application edge. The application edge and the thickness of the application member are selected for a central portion of the edge to be urged against a joint defined by contiguous flat drywall sheets. The application surface on opposite sides of the central portion flex to define a smooth continuous surface from the central portion to points on the drywall sheets spaced from the joint. The tool urges drywall compound within the joint to assume a smooth surface filling the joint and fanned away from the joint into smooth continuity with the drywall sheets.

The Kranz, et al. tool is perhaps the most visually similarly appearing to the tool of the present invention, which will also be found to be of resilient flexible material. However, the contours of the tool of the present invention will later be observed, in accordance with the tool's function performed on a workpiece wall of different contour than is addressed by the Kranz, et al. tool, to be different than the Kranz, et al. tool U.S. Pat. No. 4,946,360 to Brown for a FINISHING TOOL concerns a finishing tool providing a smooth finish to taped coved joints or to corner joints having an angle greater than ninety degree defined by converging wall board surfaces is presented. The finishing tool includes a working plate and a supporting plate, each being provided with a substantially straight edge disposed transversely to the longitudinal axes of the tool. Each of the working and supporting plates is formed of resilient material to provide longitudinal and latitudinal flexural movement so as to allow the entire length of the straight edge of the working plate to engage seam sealing material applied to the corner joint and the adjacent wall board surfaces to provided the corner joint.

The Brown tool, although distinctly different than the tool of the present invention, will later be seen to deal with corner joints that, in having a greater than ninety degree angle, are representative of some (but not all) of the joints dealt with by the tool of the present invention.

U.S. Pat. No. 5,010,618 for a CORNER FINISHING TOOL to Croft concerns a corner finishing tool for use in drywall finishing that consists of wings spreading from a center ridge that is configured to cut through drywall compound ("mud") on a wall corner, the wings including mud dams formed on their wall engaging faces to smooth tops from the mud and to spread a mud impregnated tape in from that wall joint and to direct excess mud into a space formed by that ridge, the dams and a flange projecting rearwardly from the peripheral edges of the wings.

U.S. Pat. No. 5,240,394 for a CORNER RADIUS TOOL to James concerns a corner radius tool is provided for use in applying plaster material or the like to an inside corner joint between drywall panels to form a controlled and smoothly joined surface. The tool includes a tool head in the form of a forwardly open resilient cup carried at a forward end of a tool handle, wherein the cup is adapted to support a quantity of the plaster material as the handle is manipulated to press and spread the plaster material along the inside corner joint. The resilient cup deforms upon engagement with the drywall panels at the corner joint to spread the plaster material with a desired and smoothly radiased surface. The specific radiased geometry of the plaster material surface is variably controlled by varying the orientation of and manual pressure applied to the resilient cup.

The Croft and the James tools are primarily of interest for showing prior art handled drywall corner tools.

SUMMARY OF THE INVENTION

The present invention contemplates a handheld, durable, easy-maintenance, easy-hold, precision-contour drywall finishing tool for both cleaning, and coving, dry wall panels abutting at certain range of angles.

The tool has and presents both (i) convex and (ii) concave, or bull-nose, portions at its arcuate periphery. Both peripheral portions are suitable to contour and to sculpt flowable building material into joints formed between abutting planar sheets of solid, drywall, building material. The convex portion is used for coving (dictionary definition: to make in a hollow concave form), and is more preferably used to cove joints formed from dry wall sheets abutted at an obtuse angle >90° but <180°. The concave, or bull-nose, tool portion is used for cleaning of drywall compound already applied to the reverse side of the same obtuse angle joints, i.e., where the surfaces are angled >180° but <270°.

The drywall tool of the present invention is thus a specialty tool directed neither to the 180° butt and tapered joints, nor to the 90° corner joints, that are most common in construction, but rather to those joints that are formed when planar building material panels meet at obtuse angles that are not integer multiples of 90°. For these joints the tool serves for both (i) coving and (ii) cleaning.

In its preferred embodiment, the present invention is contained in a handheld drywall tool in the substantial shape of a substantially circular disk. The major portion of the disk's peripheral edge is convex, in a circular arc. However, a minor portion of the disk's peripheral edge is relieved in the contour of a concave curve, or bull nose. That major portion of the disk's edge that is in circular in contour preferably exceeds 270° of arc of the overall circumference of the disk, and is more preferably about 315°. The minor portion of the disk's edge that is relieved in the concave curve, or bull nose, is preferably less than 90° of the overall circumference of the disk, and is more preferably only about 45° of the periphery of the disk, or but one-eighth the overall circumference of the disk. Such a small peripheral region of variant contour is why the "disk" is so called, and why it is deemed "substantially circular" in form.

Although this (substantially) disk-shaped tool visually appears to be simple, and although the tool is preferably constructed both simply and economically by molding as a single unit, the tool incorporates at least five further, and significant, features beyond its dual convex-concave arcuate edge.

First, the disk-shaped tool is made of flexible, typically elastomeric and most commonly neoprene rubber, material so that it will bend slightly backward in both its major convex, and its minor concave, arcuate portions under force of being pressed and drawn by force of the hand against flowable building material during use in dry wall construction.

Second, the disk-shaped tool preferably has at least one major surface, and more preferably exactly one such major surface, that slopes from a region of greater thickness at the center of the disk to a region of lesser thickness at the arcuate edge of the disk. This sloping surface is both uniform and radially symmetric insofar as permitted by the arcuate edge of the disk body (which is relieved in a. minor, less than 90° and commonly 45°, peripheral portion). Because of this its sloping surface the disk bends slightly backward in all its arcuate portions and regions in a progressive manner, relatively greater resistance being accorded to relatively greater bending. The useful property means that the same tool which can suitably contour the finest and most delicate drywall features by use of but a feather light touch can also, if strongly pressed into a flowable construction material, suffice to trowel and to displace under strong force voluminous amounts of this material.

Normally the major surface opposite the sloping surface is flat, which is always useful in smoothing flowable building material, particularly drywall compound, in dry wall construction.

Third, the disk-shaped tool preferably has an elevated knob, suitable to be grabbed by the fingers of the hand. The knob is preferably centrally located upon and at the apex of the (single) sloping major surface of the disk. The knob presents a structure against which force of the fingers and the hand may be applied to force and to draw the tool against flowable building material during dry wall construction.

Fourth, the entire tool, including its knob, is preferably integrally molded, normally of a material that is either elastomeric (property one) or impermeable or both. This molded construction makes the tool economical, while the tool's surface to which material will not stick makes the tool both durable and easy to maintain, mainly because dried drywall mud (drywall compound) will not normally stick to any part of the tool.

Fifth, the tool preferably permanently affixes a patch hook-and-loop type material, such as Vecro™ material, at, and preferably co-extensive with, the crest of its knob. The patch of material is suitable to engage a patch of complimentary hook, or loop, material on the dry wall finishers tool belt, clothing, or elsewhere. The patch serves to hold the tool in some location suitable for convenient access between uses of the tool, and for storage.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow:

FIG. 1 is a diagrammatic perspective view showing the preferred embodiment of the drywall finishing tool of the present invention in use.

FIG. 2 is a top plan view of the preferred embodiment of a drywall finishing tool in accordance with the present invention that was previously seen in FIG. 1.

FIG. 3 is a side plan view of the preferred embodiment of a drywall finishing tool in accordance with the present invention that was previously seen in FIGS. 1 and 2.

FIG. 4 is a top plan view showing the preferred embodiment of a drywall finishing tool in accordance with the present invention, as was previously seen in FIGS. 1–3, in use upon each of the acute, and the obtuse, angle joints formed by the mating of two sheets of planar drywall construction material.

FIG. 5 is a detail view showing how the edge of the preferred embodiment of a drywall finishing tool in accordance with the present invention, previously seen in FIGS. 1–4, serves to move flowable construction material into joints between, and upon the surfaces of, planar sheets of drywall construction material.

DESCRIPTION OF THE PREFERRED EMBODIMENT

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

A preferred embodiment of a drywall finishing tool 1 in accordance with the present invention is shown in diagrammatic perspective view while in operative use in FIG. 1. The tool 1 is held by the hand (not shown) so that its relieved, concave, arcuate region 11, (also shown in FIG. 2) is centered over a joint 21 between a first planar sheet 22, and a second planar sheet 23, of, typically, drywall construction material. The tool 1 is, in particular, shown in an operation called "cleaning" where a dry wall compound 3 already in place between two abutting drywall sheets 22, 23 is being contoured, and shaped. (The use of the tool 1 more particularly in coving is shown at the top of FIG. 4, and, in side view, in FIG. 5.)

In accordance with the preferred use of the tool 1 of the present invention, these planar drywall sheets 21, 22 do not meet at 180° (as would produce a butt, or taper, joint 3), nor at 90° (as would produce a right angle corner joint 3). Instead, for use of the concave arcuate region 11 (best seen in FIG. 2) of the tool 1 on the exterior angle joint 21 as illustrated, the drywall sheets 22, 23 meet at an interior angle between 90° and 180° and, most commonly, at an angle of 135° (to be further illustrated in FIG. 4).

Drywall compound, or mud, 3 within the joint 21 is cleaned, or contoured, or smoothed by the tool 1, leaving a smooth and round curved contour surface. It will be understood that neither the planar sheets 22, 23 of drywall construction material nor the drywall compound 3 are part of the tool 1 of the present invention, but only represent the typical construction materials with which, and on which, the tool 1 of the present invention is used.

The tool 1 need not be held by the hand (hand not shown) with its major axis perpendicular to the construction material. It may be tilted so that its concavely curved, bull nose, arcuate region 11—illustrated as the operative region in FIG. 1—is angled either towards, or, most commonly, against the direction in which the tool 1 is being stroked, swept and pulled. From that partial buildup of compound 3 within the joint 21 which is shown in FIG. 1, and by momentary comparison with FIG. 5, it may be understood that, by way of example, the tool 1 as shown in FIG. 1 is being stoked in a downwards direction against the joint 21. However, it will be understood that, in accordance with the well-known principles of drywall finishing and smoothing mentioned in the BACKGROUND OF THE INVENTION section of this specification, the tool 1 may be variously swept in both downwards and upwards directions, and variously manipulated in orientation and in three-dimensional spatial position as permits and promotes that, primarily, that selected portions of its circumferential edge may serve to smooth the drywall compound 3 within the joint 21.

A top plan view of the preferred embodiment of the same drywall finishing tool 1 in accordance with the present invention that was previously seen in FIG. 1 is shown in FIG. 2, and a side plan view in FIG. 3. The tool 1 is clearly in the substantial shape of a circular disk with one flat side 12, and with one ramped side 13 which is "topped" by a central protuberance, or knob, 14 and hook-and-loop material patch (both best seen in FIG. 3). From the disk with its generally circular circumference, a concave curve, or bull nose, arcuate region 11 is relieved The patch 15 of hook-and-loop type material, such as Velcro™ material, is permanently affixed to the knob 14, normally by adhesive. The patch 15 is preferably co-extensive with the top area of the knob 15. The patch of material is suitable to engage a patch of complimentary hook, or loop, material (not shown) on the dry wall finishers tool belt, clothing, or elsewhere.

The major diameter D1 is typically 12 cm., and the minor diameter D2 of the knob 14 is typically 3 cm. The size of the concave, or bull nose, region 11 is typically such that this region would form a portion of the circumference of a wedge portion of an imaginary circle of a diameter D3 equaling 3.5 cm. The bull nose region 11 may be made larger, and/or deeper, but the proportions just given are optimal for the finishing of drywall panels joined at an interior angle of 135° (see FIGS. 1 and 4).

All portions, both convex and concave, of the edge of the disk of the tool 1 are rounded (as is best seen in FIG. 3), and this edge rounding is typically on a diameter of approximately 1 mm.

Referring to FIG. 2, the angular extent ARC1 of the convex circular periphery of the disk of the tool 1 is greater than 270°, an is most typically about 315°. Correspondingly, the angular extent ARC2 of the concave, or bullnose, portion of the periphery of the disk of the tool 1 is less than 90°, and is most typically about 45°.

Referring to the side plan view of the preferred embodiment of a drywall finishing tool 1 shown in FIG. 3, the thinnest, edge, region of the tool is everywhere of a thickness T1. The tool 1 has a typical thickness T2 at the knob 14 of about 0.75 cm, and a remaining thickness T3 to the body that is also of about 0.75 cm. Accordingly, the tool 1 has a minimum thickness of about 3 mm, a maximum thickness of about 1.5 cm., and a ramp surface 13 upon a one side that causes the thickness of the tool to increase from 3 mm to 0.75 cm over a radial distance (at any radial angle) of about 4.5 cm.

Further diagrams of the use of the tool 1 are shown in FIGS. 4 and 5. A top plan view of the preferred embodiment of the drywall finishing tool 1 in accordance with the present invention, previously seen in FIGS. 1–3, is shown in FIG. 4. Two complimentary placements, and angular orientations, of the tool 1 show just how the tool 1 may be used upon each of the interior angle joint 24, and the exterior angle joint 25, formed by the mating of two sheets 22, 23 of planar drywall construction material. (The thicknesses of the sheets 22, 23 of planar drywall construction material are not shown to scale; the broken line central to each sheet 22, 23 is so as to illustrate that only the external surfaces of the sheets 22, 23, and the two joints 24, 25 formed between them, are relevant to the tool 1 of the present invention.)

Clearly, the relived, bullnose, concave arcuate portion 11 of the tool 1 is used to smooth an contour drywall compound (3, shown in FIG. 1) into the joint 25; which joint 25 is formed at the exterior angle between two sheets 22, 23 when these sheets meet (relative to their surfaces and to the same joint 25 into which compound is being spread by the tool 1) at an interior angle that is obtuse (i.e., by dictionary definition, >90° but <180°). The sheets 22, 23 meet—relative to surfaces that form the exterior joint 25 into which compound is being spread by the tool 1—at an interior obtuse angle that is between 90° and 180° and that is, most commonly, 135°—as illustrated. The concave, or bullnose, region of the tool 1 is optimized for such an angle of 135°, and, in accordance with its flexibility in use, performs excellently on angles within 30° of 135° (i.e., from 105°–165°).

Any part or portion of the remaining, circularly convex, arcuate periphery of the tool 1 may be used in coving; forcing, smoothing and contouring the drywall compound (3, shown in FIG. 1) into and within the joint 24. The interior joint 24 is formed by the two sheets 22, 23 when these sheets meet (relative to their surfaces and to the selfsame joint 24 into which compound is being spread by the tool 1) at an interior obtuse angle of >90° but <180°. The sheets 22, 23 meet—relative to surfaces that form the joint 25 into which compound is being spread by the tool 1 at an interior obtuse angle that is more than 90° but less than 180° and that is, most commonly, 135°—as illustrated. The circularly convex circumferential regions of the tool 1 are also optimized for an angle of 135°, and, in accordance with the flexibility of the tool 1, the tool 1 performs excellently on joints made by planar sheets meeting at angles within 30° of 135° (i.e., from 105°–165°).

Some small thought will now reveal to the reader that the dimensions of the tool 1 are not haphazard. The tool, while being an overall size tractable for holding in the hand, must desirably accurately accommodate both (i) interior and (ii) exterior joints between planar sheets, particularly dry wall panels, that abut at an interior angle that is, while neither 90° nor 180°, obtuse, and within the range >90° while <180°. The described dimensions meet the dual purpose of permitting the tool 1 to function accurately and precisely on both interior and exterior joints formed by and between planar sheets, particularly dry wall panels, abut at interior angles centered about 135°.

FIG. 5 is a detail view showing how the edge of the preferred embodiment of a drywall finishing tool 1 in accordance with the present invention serves to move flowable construction material into joints between, and upon the surfaces of, planar sheets of drywall construction material. In accordance with the well-known principles of drywall finishing and smoothing mentioned in the BACKGROUND OF THE INVENTION section of this specification, it will be understood by practitioners of drywall finishing arts that the tool 1 may be variously swept in both downwards and upwards directions, and variously manipulated in both orientation and in three-dimensional spatial position as permits and promotes that, primarily, selected portions of its circumferential edge may serve to contact, and to manipulate, the drywall compound 3 into, primarily, the joint 21 (shown in FIG. 1). FIG. 5 is merely illustrative of an exemplary portion of this process.

In accordance with the preceding explanation, variations and adaptations of the drywall finishing tool in accordance with the present invention will suggest themselves to a practitioner of the tool design and/or drywall finishing arts. For example, the feature at the tool center—presently the knob 14—by which the tool may be more easily and strongly grasped and manipulated might have been, by way of example and not of limitation, a hole.

In accordance with these and other possible variations and adaptations of the present invention, the scope of the invention should be determined in accordance with the following claims, only, and not solely in accordance with that embodiment within which the invention has been taught.

What is claimed is:

1. A handheld dry wall tool comprising:

a body in the substantial shape of a disk having a center and an edge with (i) a major portion of the disk's edge being in a convex arc, and thus being a convex arcuate portion, and with (ii) a minor portion of the disk's edge being in a concave arc, and thus being a concave arcuate portion;

the disk-shaped body being made of flexible material so that the disk will bend slightly backward in both its major convex, and its minor concave, arcuate portions under force of being pressed and drawn by force of the hand against flowable building material used in dry wall construction;

the disk-shaped body of flexible material having at least one major surface that slopes from a first region at the center of the disk that is of relatively greater thickness towards a second region at the edge of the disk that is of relatively lesser thickness;

wherein, because of its sloping surface from center to edge, and its flexible material, the disk bends progressively more under increasing force, a relatively greater resistance being accorded to a relatively greater bending induced under force of being pressed and drawn by a human hand against flowable building material during use of the tool in dry wall construction.

2. The handheld drywall tool according to claim 1 wherein the flexible-material disk-shaped body's sloping surface is uniform and radially symmetric save for the convex and the concave arcuate portions of the edge of the body.

3. The handheld drywall tool according to claim 4 wherein the flexible-material disk-shaped body has its sloping surface on one side only of the body, with the surface of the opposed side being substantially flat;

wherein the flat surface is usable in smoothing flowable building material in dry wall construction.

4. The handheld drywall tool according to claim 1 wherein the disk-shaped body comprises:

an elevated knob, suitable to be grabbed by the fingers of the hand, upon a major surface of one side of the body;

wherein by force of the fingers against the knob, the tool may more easily be forced and be drawn by the hand against flowable building material during dry wall construction.

5. The handheld drywall tool according to claim 4 wherein the disk-shaped body's elevated knob is centrally located.

6. The handheld drywall tool according to claim 5 wherein the disk-shaped body's elevated knob is in the substantial shape of a cylinder centrally protruding from the major surface of the body.

7. The handheld drywall tool according to claim 5 further comprising:

a patch of hook-and-loop type material affixed atop the elevated knob;

wherein the tool may be held during periods of non-use to a complimentary patch of complimentary-type hook and loop material.

8. The handheld drywall tool according to claim 4 wherein the disk-shaped body's elevated knob is integrally formed with the material of the disk.

9. The handheld drywall tool according to claim 8 wherein the disk-shaped body and its elevated knob are integrally formed by being molded of elastomeric material.

10. The handheld drywall tool according to claim 1 wherein the convex arcuate portion of the disk's edge exceeds 270° of the circumference of the disk; and wherein the concave arcuate portion of the disk's edge is less than 90° of the circumference of the disk.

11. The handheld drywall tool according to claim 10 wherein the convex arcuate portion of the disk's edge is 315° of the circumference of the disk; and wherein the concave arcuate portion of the disk's edge is 45° of the circumference of the disk.

12. A process of using the tool of claim 1 in cleaning a dry wall joint of an angle between 105° and 165° between abutting dry wall panels, the process comprising:

drawing the convex arcuate portion of the disk over the drywall joint and between the abutting dry wall panels with sufficient pressure into the joint so as to bend the disk and smoothly clean the joint.

13. A process of using the tool of claim 1 in coving a dry wall joint of an angle >90° and <180° between abutting dry wall panels, the process comprising drawing the concave arcuate portion of the disk over the drywall joint and between the abutting dry wall panels with sufficient pressure into the joint so as to bend the disk and cove the joint.

14. A handheld drywall tool comprising:

a flexible body in the substantial shape of a disk having a center, an edge and major side surfaces, with a major arcuate portion of the disk's edge being in shape of a convex curve and with a minor arcuate portion of the disk's edge being in shape of a concave curve;

with at least one major side surface of the body sloping from a region of greater thickness towards the center of the disk to a region of lesser thickness at the edge of the disk; and with an elevated knob centrally located on and extending from the sloping major side surface;

wherein the body can be grabbed by the fingers of the hand, as are aided by the knob, and forced and drawn by the hand, while the body bends slightly and relatively evenly and uniformly in all portions, against flowable building material during dry wall construction so as to, dependent upon whether the tool is rotationally oriented so that its convex, or its concave, arcuate portion contacts the flowable building material, draw and shape the flowable building material into, respectively, a concave or a convex curved surface.

15. The handheld drywall tool according to claim 14 further comprising:

a patch of hook-and-loop type material affixed atop the elevated knob.

16. A handheld spreader tool that is thicker at its circular center and thinner at its periphery, the spreader tool comprising:

a flexible body with a convexly-curved portion at greater than a 270° arcuate portion of its periphery, and a concavely-curved portion at less than a 90° arcuate portion of its periphery;

wherein the flexible body may be deformed by squeezing, twisting and manipulating with a human hand, the thickness and bending strength thereof being less at the thinner periphery, so that the periphery of the flexible body becomes manipulated and curved or deformed to a lesser extent than does the center of the flexible body where in contouring, sculpturing and control may be provided over a liquid material which is being worked into a joint between solid planar materials.

* * * * *